US005689076A

United States Patent [19]

Usuda

[11] Patent Number: 5,689,076

[45] Date of Patent: Nov. 18, 1997

[54] DRUM ADJUSTMENT APPARATUS

[76] Inventor: Shinichi Usuda, 3-41-20 Matubara Setagayaku, Tokyo, Japan

[21] Appl. No.: 829,918

[22] Filed: Feb. 4, 1992

[51] Int. Cl.[6] ..... G10G 7/00

[52] U.S. Cl. ..... 84/458; 84/453; 224/269; 224/197

[58] Field of Search ..... 84/458, 413, 411 A, 84/411 R, 453; 70/456 R, 459; 24/599.8, 599.7; 224/252, 249, 250, 269, 197

[56] References Cited

U.S. PATENT DOCUMENTS

| | | | |
|---|---|---|---|
| 1,270,158 | 6/1918 | Hill | 224/252 |
| 3,126,603 | 3/1964 | Cedarstaff | 70/459 |
| 3,148,812 | 9/1964 | Hilsinger, Jr. | 224/250 |
| 4,218,952 | 8/1980 | Arbiter | 84/458 |
| 4,496,088 | 1/1985 | Tuthill | 224/250 |
| 4,870,883 | 10/1989 | Gauger | 84/413 |
| 4,903,569 | 2/1990 | Kurosaki | 84/413 |

*Primary Examiner*—Cassandra C. Spyrou
*Attorney, Agent, or Firm*—Freilich, Hornbaker & Rosen

[57] ABSTRACT

A drum adjustment apparatus (60) is disclosed which retains a drum key (50) on the clothes of a user for ready access in adjusting the tension of drum heads. An envelope (64) mounts the drum key to a rotatable yoke (72) of a spring loaded snap (80) which may be attached to a belt loop of the user and left there while making fine drum head tuning adjustments.

4 Claims, 2 Drawing Sheets

DRUM ADJUSTMENT APPARATUS

FIELD OF THE INVENTION

The present invention relates generally to drums and more particularly to apparatus for the adjustment thereof.

BACKGROUND OF THE INVENTION

Modern drums typically have a drumhead attached to an annular collar which may be moved relative the drum shell to adjust the tension of the drumhead. Musicians adjust this tension with a drum key to obtain the sound they desire. Drum keys are small and easily misplaced. Because the drum adjustments are made frequently, significant time could be saved if the drum key were made readily available to the musician while at work.

SUMMARY OF THE INVENTION

The present invention is directed to apparatus for retaining a drum adjustment key on a user thereof for ready access thereto.

Apparatus in accordance with the invention are characterized by structure for rotatably attaching the drum key to the clothes of the user while exposing the drum key end for engagement with the tension rods of a drum.

In a preferred embodiment an envelope encloses the drum key and is retained on a rotatable yoke of a spring loaded snap which may attach to a belt loop of the user. Thus the drum key is retained for ready access and may be employed in adjusting tension rods without removal from the user's clothes.

The novel features of the invention are set forth with particularity in the appended claims. The invention will be best understood from the following description when read in conjunction with the accompanying drawings.

DETAILED DESCRIPTION

Figure 1:
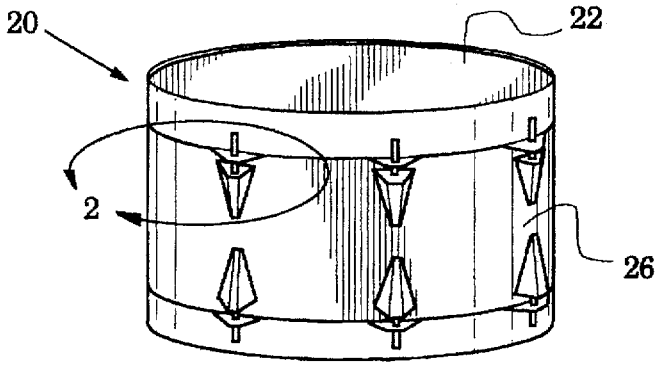
FIG. 1 is a perspective view of a typical modern drum.
Figure 2:
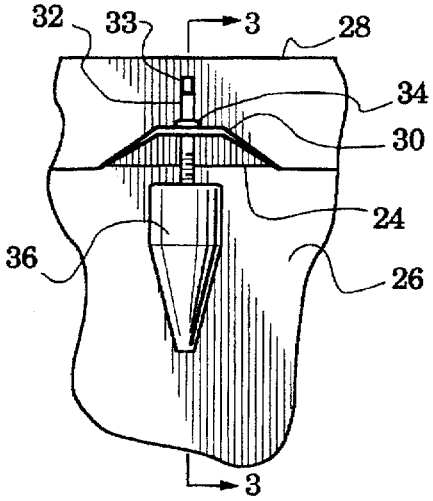
FIG. 2 is an enlarged view of the area within the line 2 of FIG. 1.

FIG. 1 is a perspective view of a typical modern drum 20 having a pair of drumheads 22 (only one drumhead is visible). FIG. 2 is an enlarged view of the area within the line

Figure 3:
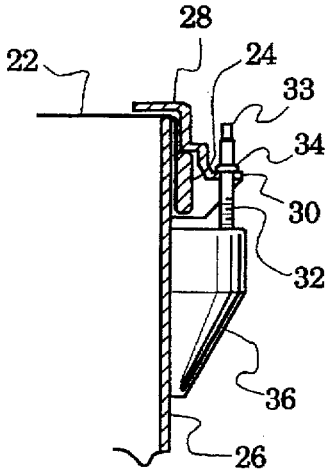
FIG. 3 is a sectional view along the plane 3—3 of FIG. 2.

2 of FIG. 1 illustrating typical drum apparatus for adjusting the drumhead tension while FIG. 3 is a sectional view along the plane 3—3 of FIG. 2.

FIGS. 2 and 3 show that the drumhead 22 is attached (e.g. by epoxy) to an annular collar 24 that fits about the drum shell 26. A rim 28 is configured to abut the collar 24 while also being spaced from the edge of the shell 26. The rim 28 is bent locally to form a lip 30 to receive a tension rod 32 which terminates in a square shaft 33. The tension rod 32 defines an annular skirt 34 that abuts the lip 30. The tension rod 32 is threadably received in a boss 36 mounted to the shell 26. Thus turning the tension rod 32 moves the rim 28 and collar 24 relative to the shell 26 to adjust the tension of the drumhead 22.

Figure 4:
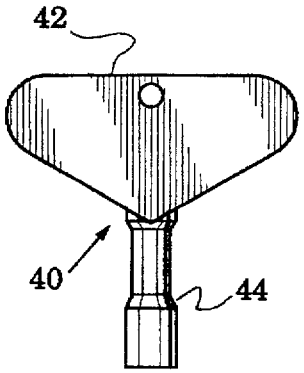
FIG. 4 is an front elevation view of a drum key in an enlarged scale relative to FIGS. 2 and 3.
Figure 5:
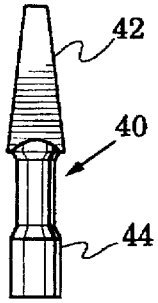
FIG. 5 is a side elevation view of the drum key of FIG. 4.
Figure 6:
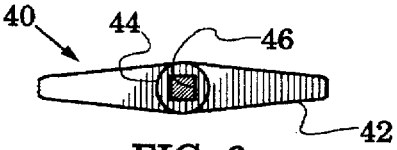
FIG. 6 is a bottom plan view of the drum key of FIG. 4.

Musicians frequently adjust, in sequence, the tension rods 32 surrounding the drum shell 26 to obtain a desired tone. This adjustment is typically effected by using a drum key 40 as illustrated in the front elevation view of FIG. 4. The drum key 40 is also shown in the side elevation view of FIG. 5 and the bottom plan view of FIG. 6.

Figure 7:
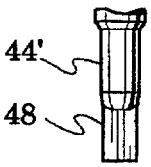
FIG. 7 is a front plan view of an alternate end of the drum key of FIG. 4.
Figure 8:
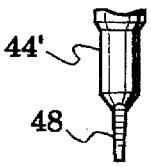
FIG. 8 is a side elevation view of the drum key end of FIG. 7.

The drum key 40 has a flat handle 42 and an end 44 defining a substantially square recess 46 which can be placed over the square shaft 33 of the tension rod 32 (as shown in FIGS. 2, 3). Some drums have tension rods that terminate in a slotted head. FIGS. 7 and 8 are, respectively, front elevation and side elevation views of another drum key end 44' configured as a flat blade 48 to mate with such tension rods.

As stated above, the tone of a drum is frequently adjusted and, often, a musician plays a drum set which involves a multiplicity of such adjustments. The drum key is thus an important tool to which the musician requires ready access. Unfortunately, the drum key is also a small tool that is easily misplaced.

Therefore, to provide a musician ready access to a drum key, a preferred drum adjustment apparatus 60, in accordance with the present invention, is provided as shown in FIGS. 9–12. The apparatus 60 includes means to rotatably and removably attach the drum key to the user's clothing. A user of the apparatus can quickly remove the drum key for use and then replace it on his clothing. Alternatively, a user of the apparatus 60 may place himself adjacent a drum and, leaving the apparatus 60 attached to his clothing (e.g. a belt loop), make free drum head tuning adjustments.

Figure 9:
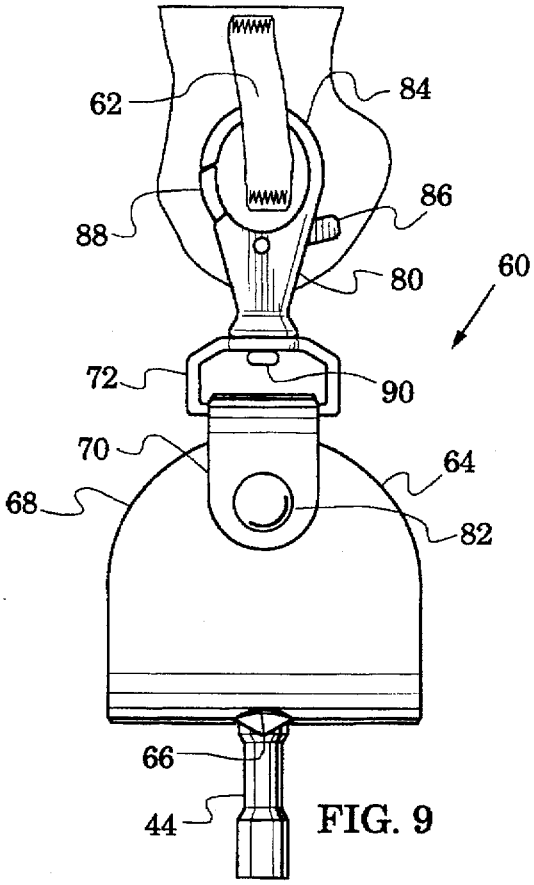
FIG. 9 is a front elevation view of a preferred drum adjustment apparatus embodiment in accordance with the present invention.
Figure 10:
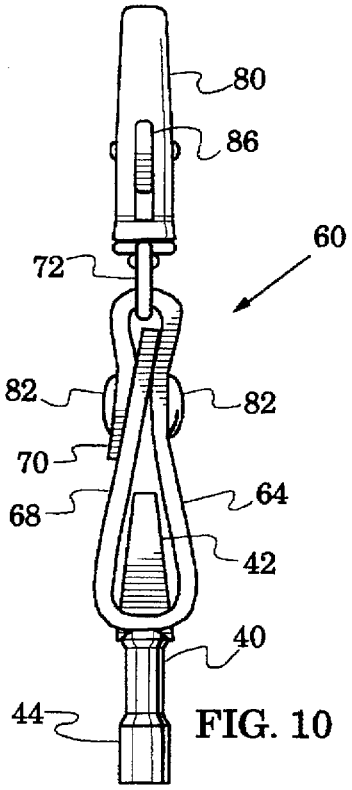
FIG. 10 is a side elevation view of the apparatus of FIG. 9.
Figure 11:
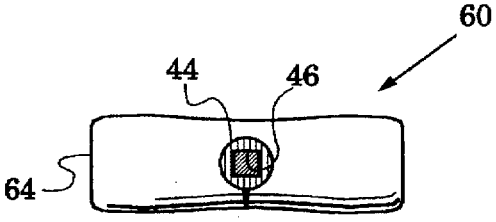
FIG. 11 is a bottom plan view of the apparatus of FIG. 9.

In particular, FIGS. 9, 10, 11 and 12 are, respectively, front elevation, side elevation, bottom plan and rear elevation views of the apparatus 60. FIG. 9 illustrates the apparatus 60 attached to a user's belt loop 62. A resilient leather envelope 64 encloses the drum key 40. The envelope 64 defines a hole 66 which receives the drum key end 44 in a manner that exposes the end 44 for use. The envelope 64 also defines a body 68 terminating in a tongue 70 which can be inserted in the yoke 72 of a spring loaded snap 80. The tongue 70 is removably fastened to the body 68 with a conventional snap stud and socket 82.

Figure 12:
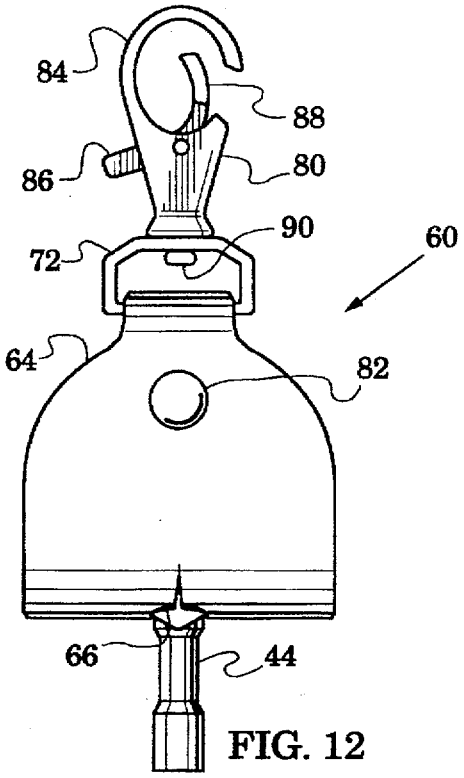
FIG. 12 is a rear elevation view of the apparatus of FIG. 9.

The spring loaded snap 80 defines a loop 84 and a tab 86 is rotatably mounted therein which defines a loop portion 88. When the tab 86 is depressed as shown in FIG. 12 the portion 88 is moved to a position which allows the loop 84 to be attached to the belt loop 62 as shown in FIG. 9. The yoke 72 is rotatably mounted on a stud 90 of the snap 80 thus allowing the envelope 64 and enclosed drum key 40 to rotate while the apparatus remains attached to the belt loop 62. The spring loaded snap 80 is of a type well known in the art.

From the foregoing it should now be recognized that a drum adjustment apparatus embodiment has been disclosed herein configured for attachment to a user's clothes and especially suited for retaining a drum key for ready use in adjusting the tone of a drum head. An apparatus in accordance with the present invention enables a user thereof to reduce time needed to make drum adjustments because the drum key is always readily available for use.

The preferred embodiment of the invention described herein is exemplary and numerous modifications, dimensional variations and rearrangements can be readily envisioned to achieve an equivalent result, all of which are intended to be embrace within the scope of the appended claims.

What is claimed is:

1. A drum adjustment apparatus, comprising:

a drum key defining an end configured to mate with a drum tension rod for adjustment thereof;

means for rotatably attaching said drum key to the clothes of a user of said apparatus for use in adjusting the tension of a drumhead, said apparatus thereby conveniently retained on said user for ready use, said means including a spring loaded snap dimensioned to be removably attached to a belt loop of said user of said apparatus, said snap having a rotatable yoke; and means for removably mounting said drum key to said yoke, said mounting means exposing said drum key end for mating with said tension rod.

2. The apparatus of claim 1 wherein said mounting means comprises:

a leather envelope defining a body and a tongue extending from said body for insertion through said yoke, said body defining a hole for receiving said drum key end; and means for removably fastening said tongue on said body to enclose said drum key.

3. The apparatus of claim 2 wherein said fastening means comprises a snap stud and snap socket, one of said stud and said socket attached to said tongue and the other of said stud and said socket attached to said body.

4. A drum adjustment apparatus, comprising:

a drum key defining an end configured to mate with a drum tension rod for adjustment thereof;

means for rotatably attaching said drum key to the clothes of a user of said apparatus for use in adjusting the tension of a drumhead, said apparatus thereby conveniently retained on said user for ready use;

wherein said drum key end defines a recess with a substantially square cross section for mating with a drum tension rod defining a square shaft.

* * * * *